US009574557B2

(12) United States Patent
Hay et al.

(10) Patent No.: US 9,574,557 B2
(45) Date of Patent: Feb. 21, 2017

(54) SUBSEA PRESSURE COMPENSATING PUMP APPARATUS

(71) Applicant: Oceaneering International, Inc., Houston, TX (US)

(72) Inventors: Donald Hay, Houston, TX (US); Jake Hennig, Cypress, TX (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 379 days.

(21) Appl. No.: 14/340,390

(22) Filed: Jul. 24, 2014

(65) Prior Publication Data

US 2016/0025085 A1 Jan. 28, 2016

(51) Int. Cl.

| | |
|---|---|
| ***F04D 13/08*** | (2006.01) |
| ***F04B 43/02*** | (2006.01) |
| ***F04D 25/06*** | (2006.01) |
| ***F04B 53/16*** | (2006.01) |
| ***F04B 53/18*** | (2006.01) |
| ***F04B 23/02*** | (2006.01) |

(52) U.S. Cl.

CPC ..... *F04B 43/02* (2013.01); *F04B 23/02* (2013.01); *F04B 53/16* (2013.01); *F04B 53/18* (2013.01); *F04D 13/08* (2013.01); *F04D 13/086* (2013.01); *F04D 25/0686* (2013.01)

(58) Field of Classification Search

CPC ..... F04B 47/06; F04D 13/08; F04D 13/086; F04D 25/0686; F15B 21/006

See application file for complete search history.

(56) References Cited

U.S. PATENT DOCUMENTS 3,753,494 A * 8/1973 Hirata ..... B65D 88/78 114/257

3,987,708 A 10/1976 Uhrich (Continued)

OTHER PUBLICATIONS

International search report and written opinion of the international searching authority for co-pending PCT application No. PCT/US2015/041808 mailed Oct. 19, 2015.

(Continued)

*Primary Examiner* — Patrick Hamo

(74) *Attorney, Agent, or Firm* — Baker & McKenzie LLP

(57) ABSTRACT

The present disclosure relates, according to some embodiments, to fluid pump apparatuses. A fluid pump apparatus may comprise a suction compensator, a housing compensator, and a pump. A suction compensator may comprise an ambient fluid compensator, an ambient fluid bladder, and a spring compensator, wherein the spring compensator comprises a first separator partitioning an internal volume of the spring compensator into a first suction fluid chamber and a compensation fluid chamber. A housing compensator may comprise a second separator partitioning an internal volume of the housing compensator into a second suction fluid chamber and a lubrication fluid chamber. The compensation fluid chamber may be in fluid communication with the suction compensator. The first suction fluid chamber may be in fluid communication with the second suction fluid chamber. A pump may comprise a housing defining a lubrication fluid compartment in fluid communication with the lubrication fluid chamber.

23 Claims, 10 Drawing Sheets

(56) References Cited

U.S. PATENT DOCUMENTS

| | | | | |
|---|---|---|---|---|
| 4,230,422 | A * | 10/1980 | Brown | B65D 88/78 114/257 |
| 6,059,539 | A | 5/2000 | Nyilas et al. | |
| 7,270,907 | B2 * | 9/2007 | Becerra | H01M 8/02 220/530 |
| 7,424,917 | B2 | 9/2008 | Martin | |
| 8,113,792 | B2 | 2/2012 | De Boer | |
| 8,387,817 | B1 * | 3/2013 | Zelechonok | B65D 77/065 137/259 |
| 8,905,677 | B2 * | 12/2014 | Hantz | B65D 90/48 114/256 |
| 9,234,400 | B2 * | 1/2016 | Warnock, Jr. | E21B 33/0355 |
| 2011/0147002 | A1 * | 6/2011 | Kotrla | E21B 33/0355 166/363 |
| 2012/0279720 | A1 * | 11/2012 | Whitby | E21B 33/0355 166/363 |
| 2014/0133922 | A1 * | 5/2014 | Hantz | B65D 90/48 405/210 |
| 2014/0147299 | A1 | 5/2014 | Tomter | |

OTHER PUBLICATIONS

Written opinion of the international searching authority for co-pending PCT application No. PCT/US2015/041808 mailed Oct. 19, 2015.

* cited by examiner

SUBSEA PRESSURE COMPENSATING PUMP APPARATUS

FIELD OF THE DISCLOSURE

The present disclosure relates, in some embodiments, to methods, apparatus, and systems for pumping fluids with dynamic pressure compensation in subsea environments.

BACKGROUND OF THE DISCLOSURE

Pressure changes as a function of seawater depth (approximately 1 bar per 10 meters), temperature, and salinity. For example, fluids and equipment (e.g., tanks, pumps) lowered from the surface to a depth of 10,000 feet would experience a substantial increase in pressure. In addition, pressure changes in a fluid volume may occur when equipment (e.g., pumps) operates. Subsea installation an operation of subsea fluid systems may be encumbered by such pressure changes.

SUMMARY

Accordingly, a need has arisen for improved methods, apparatus, and systems for pumping fluids with dynamic pressure compensation in subsea environments.

The present disclosure relates, according to some embodiments, to fluid pump apparatuses that may comprise a suction compensator, a housing compensator, and a pump. A suction compensator may comprise an ambient fluid compensator and a spring compensator. In some embodiments, an ambient fluid compensator and a spring compensator may be interconnected. An ambient fluid compensator may define a first internal volume. An ambient fluid bladder may be disposed within a first internal volume. An ambient fluid bladder may be in fluid communication with ambient fluid. An ambient fluid bladder may partition a first internal volume into a bladder volume and a residual volume.

A spring compensator may comprise a second internal volume. A first separator may partition a second internal volume into a first suction fluid chamber and a compensation fluid chamber. A spring may be disposed within a first suction fluid chamber. A compensation fluid chamber may be in fluid communication with a residual volume of a suction compensator.

A housing compensator may comprise a third internal volume. A second separator may partition a third internal volume into a second suction fluid chamber and a lubrication fluid chamber. A second suction fluid chamber may be in fluid communication with a first suction fluid chamber of a suction compensator.

A pump may comprise a housing defining a first lubrication fluid compartment. A first lubrication fluid compartment may be in fluid communication with a lubrication fluid chamber of a housing compensator. A first lubrication fluid compartment may be connectable with a suction circuit and a discharge circuit.

In some embodiments, a fluid pump apparatus may further comprise a motor comprising a second lubrication fluid compartment. A second lubrication fluid compartment may be in fluid communication with a first lubrication fluid compartment. Additionally or alternatively, a second lubrication fluid compartment may be in fluid communication with a lubrication fluid chamber of a housing compensator.

In some embodiments, fluid communication between a residual volume of a suction compensator and a compensation fluid chamber may be established by a fluid line therebetween. Fluid communication between a lubrication fluid chamber and a first lubrication fluid compartment may also be established by a fluid line therebetween.

In some embodiments, ambient fluid may comprise seawater. A compensation fluid may be disposed within a residual volume of a suction compensator and a compensation fluid chamber. A compensation fluid may, for example, be mineral oil. A suction fluid may be disposed within a first suction fluid chamber and a second suction fluid chamber. A lubrication fluid may be disposed within the housing. A lubrication fluid may be high performance gear and bearing oils.

According to another aspect of the present disclosure, methods of operating a fluid pump apparatus are provided. A method may comprise providing a fluid pump apparatus, disposing a compensation fluid within a residual volume and a compensation fluid chamber, disposing a suction circuit fluid within a first suction fluid chamber and a second suction fluid chamber, disposing a lubrication fluid within a lubrication fluid chamber and a first lubrication fluid compartment, and submerging a fluid pump apparatus in an ambient fluid environment.

In some embodiments, methods may further comprise receiving an ambient fluid into an ambient fluid bladder, whereby receiving an ambient fluid into an ambient fluid bladder may expand a bladder volume and reduce a residual volume. Methods may further comprise exerting pressure against a first separator, whereby exerting pressure against a first separator may decrease a volume of a first suction fluid chamber. Exerting pressure against a second separator, whereby exerting pressure against a second separator may increase a volume of a second suction fluid chamber and may reduce a volume of a first lubrication fluid compartment. Method may further comprise operating a pump.

In some embodiments, methods may further comprise shutting down a pump, and receiving water hammer fluid into a first suction fluid chamber, whereby receiving a water hammer fluid may expand a spring and may increases a volume of a first suction fluid chamber. Methods may further comprise exerting pressure against an ambient fluid bladder, whereby exerting pressure against an ambient fluid bladder may expel at least a portion of an ambient fluid into an ambient fluid environment.

In some embodiments, methods may further comprise retrieving a fluid pump apparatus from an ambient fluid environment.

BRIEF DESCRIPTION OF THE DRAWINGS

Some embodiments of the disclosure may be understood by referring, in part, to the present disclosure and the accompanying drawings, wherein.

Figure 1:
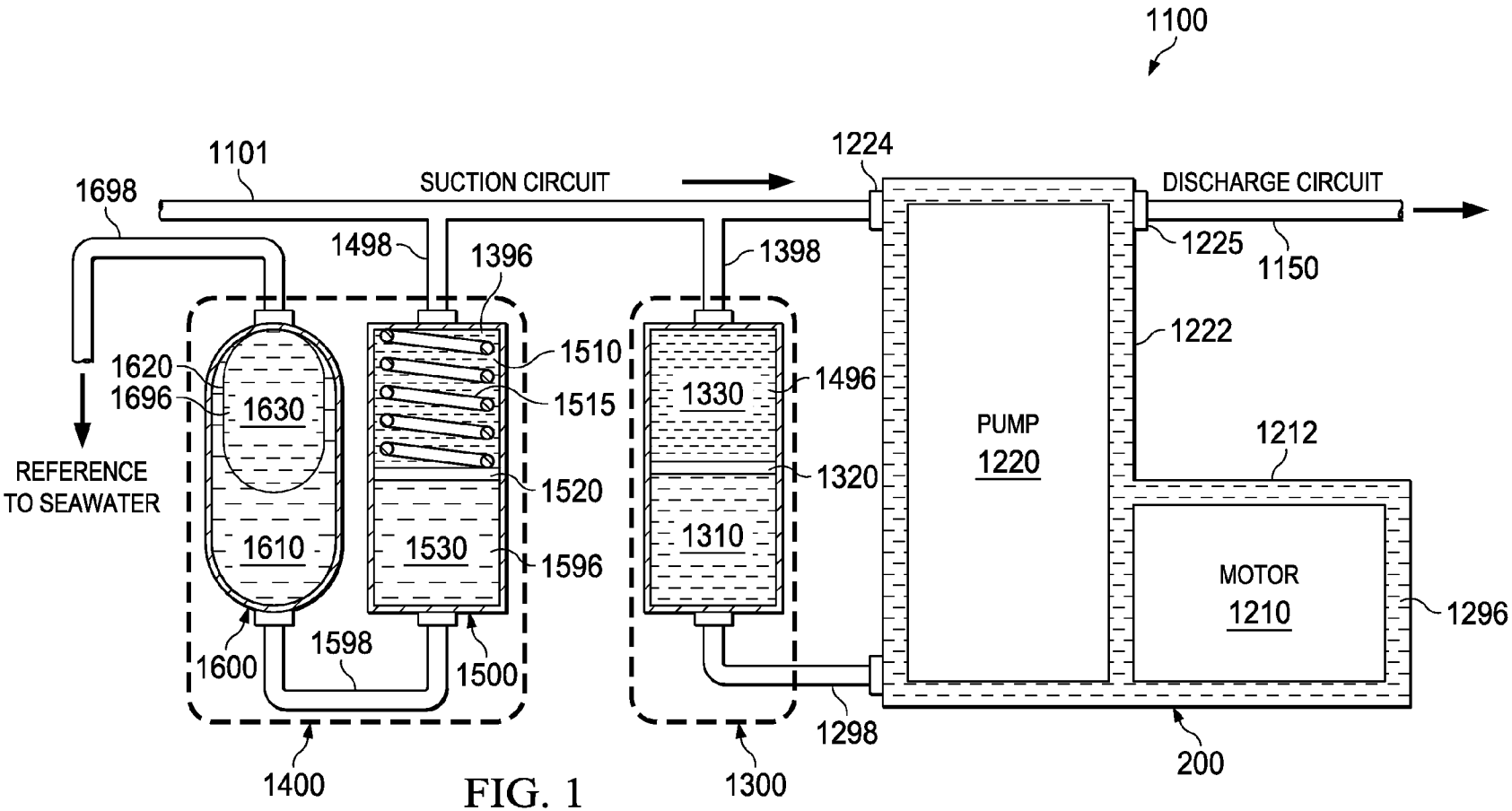
FIG. 1 illustrates a schematic of a subsea pressure compensating pump unit according to a specific example embodiment of the disclosure.

Table 1 below includes the reference numerals used in this application. The thousands and hundreds digits correspond to the figure in which the item appears while the tens and ones digits correspond to the particular item indicated. Similar structures share matching tens and ones digits.

Figure 2A:
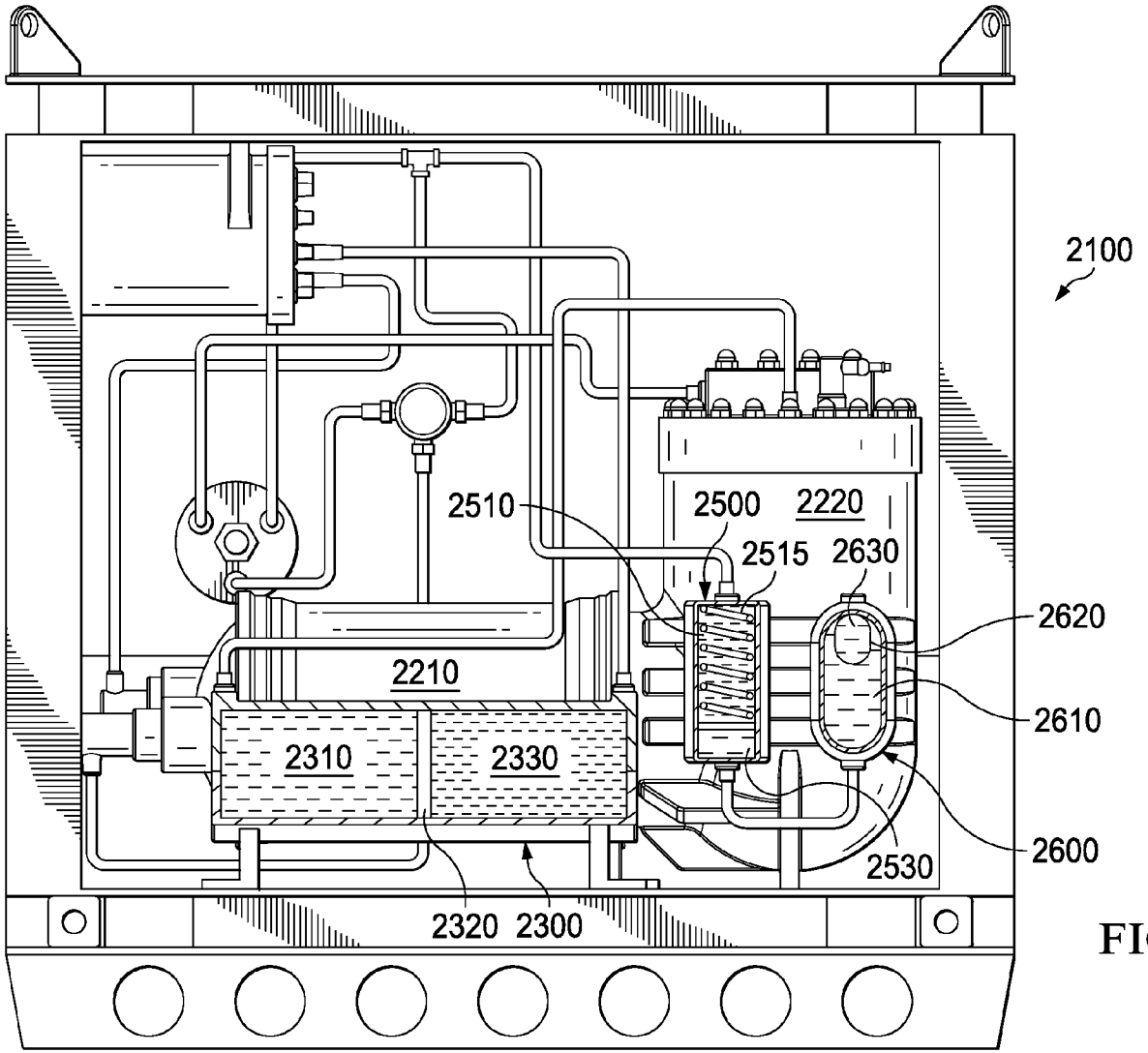
FIG. 2A illustrates a subsea pressure compensating pump unit according to a specific example embodiment of the disclosure.
Figure 2B:
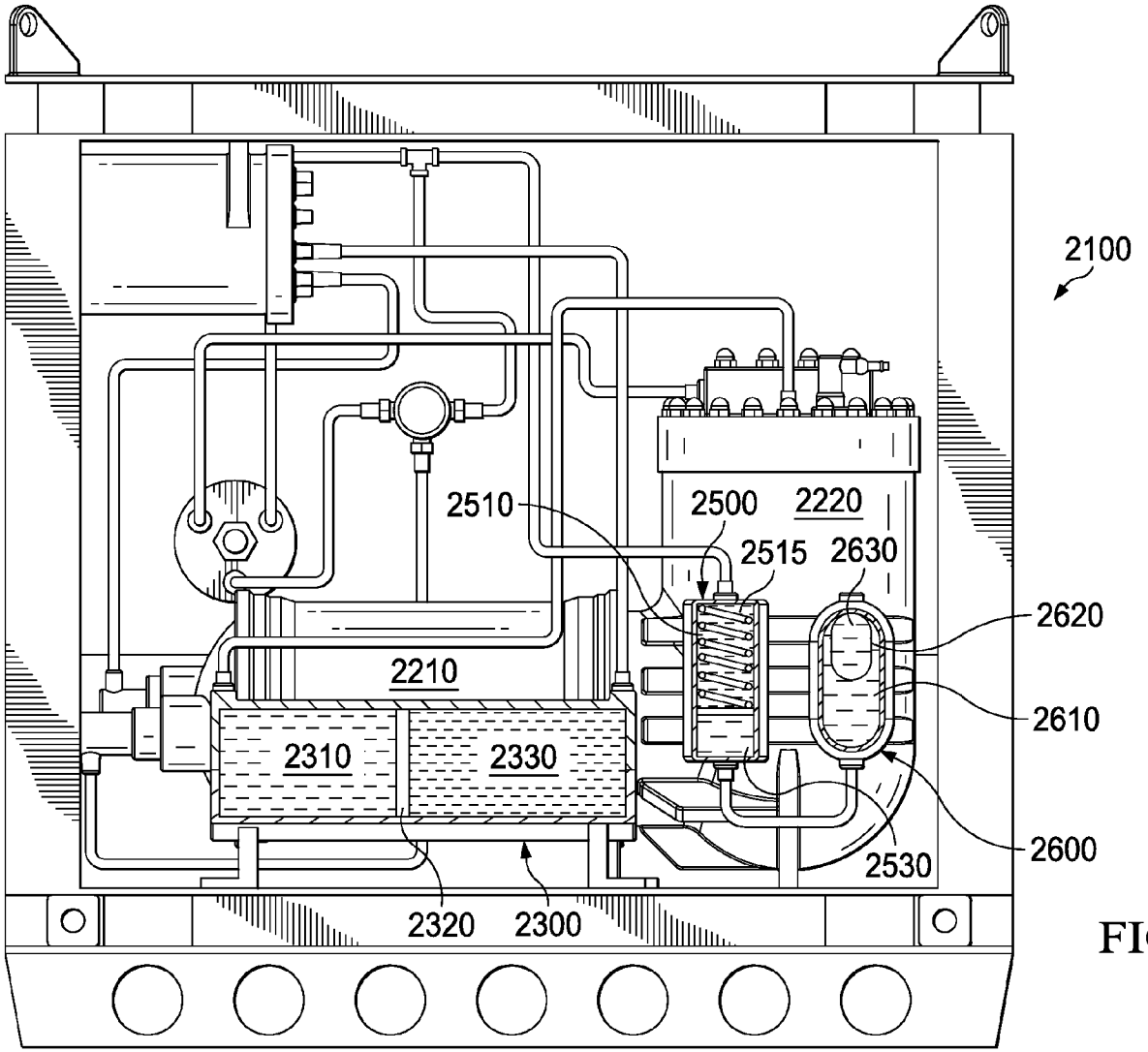
FIG. 2B illustrates a subsea pressure compensating pump unit according to a specific example embodiment of the disclosure.
Figure 2C:
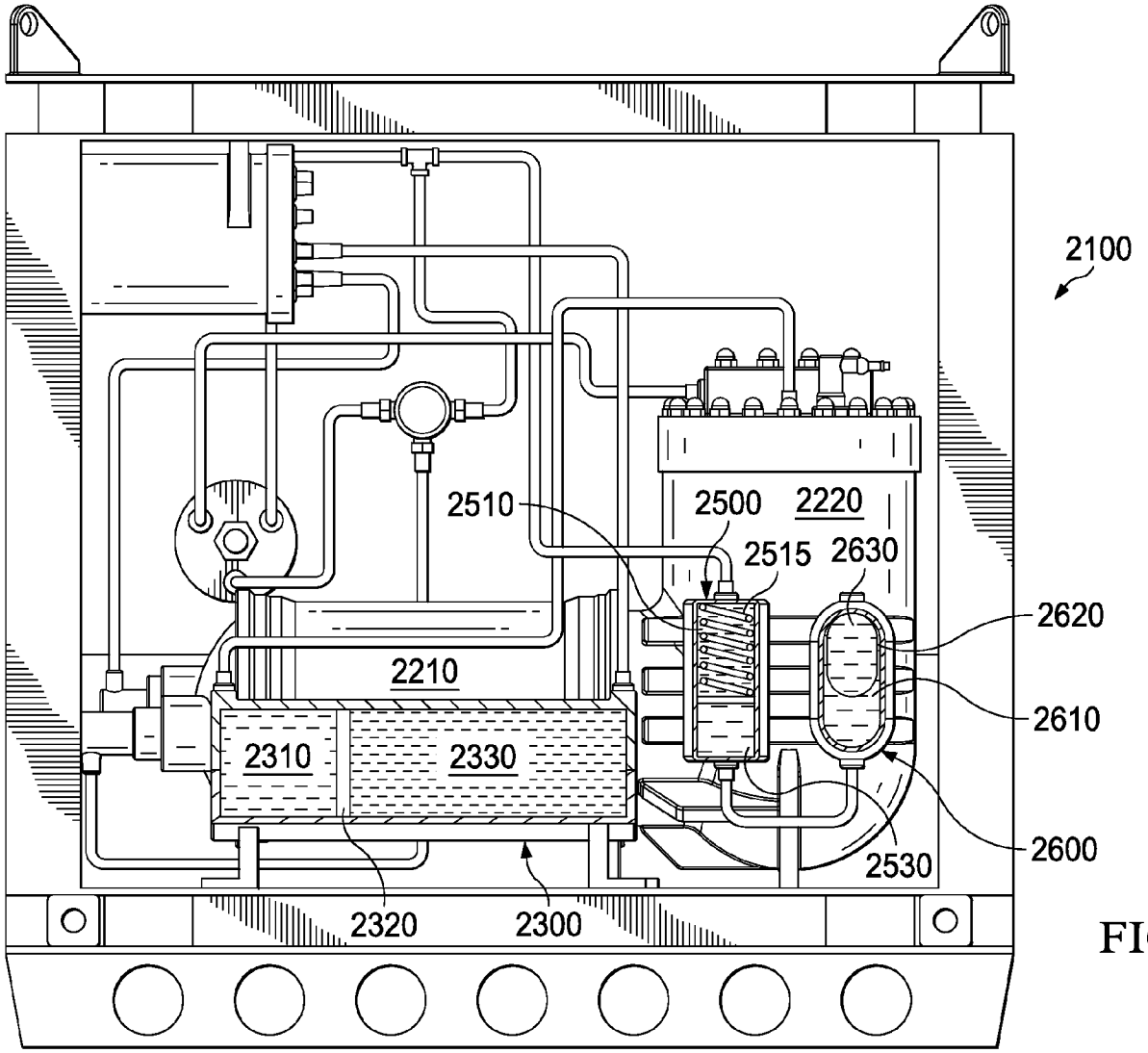
FIG. 2C illustrates a subsea pressure compensating pump unit according to a specific example embodiment of the disclosure.
Figure 2D:
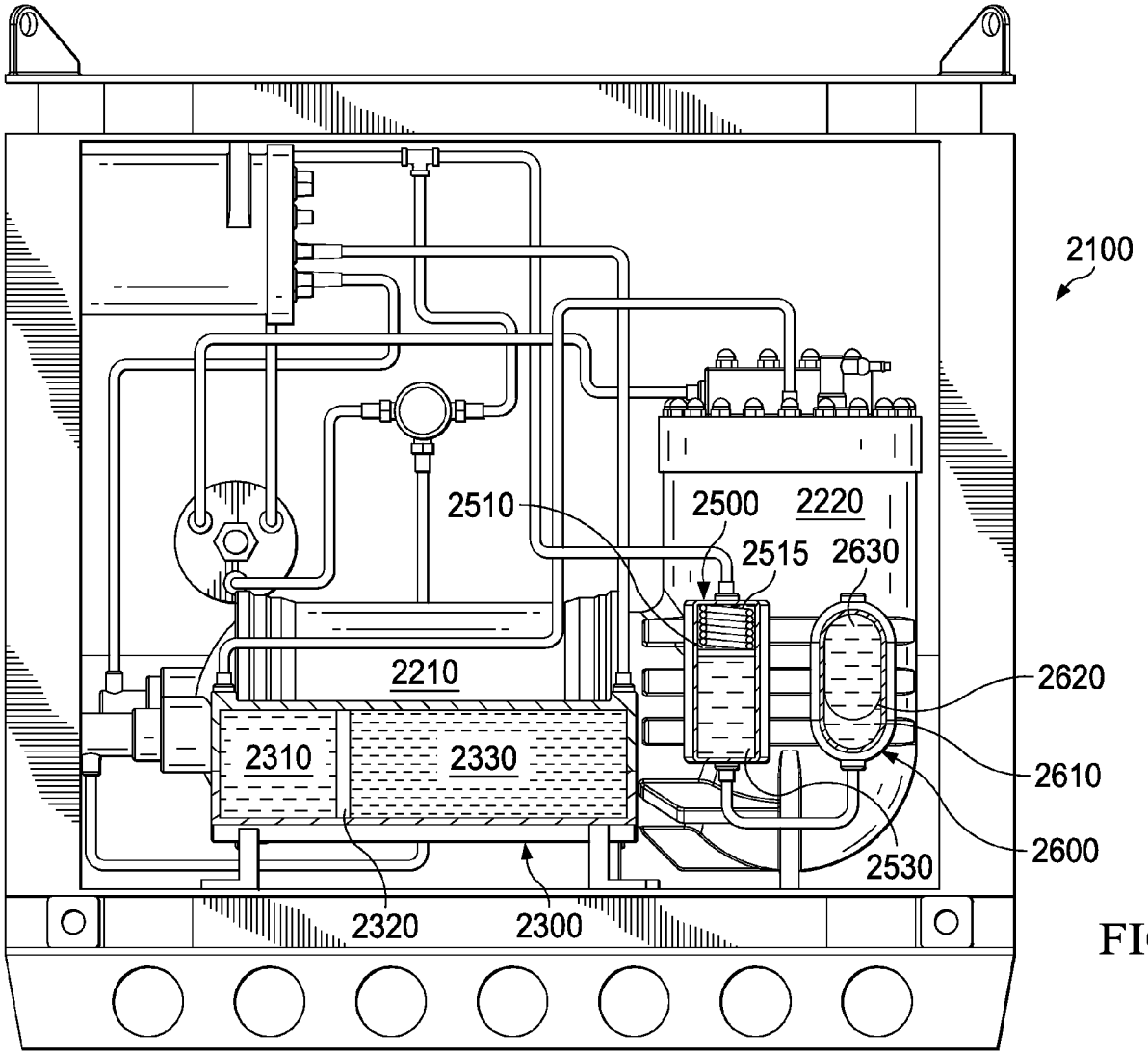
FIG. 2D illustrates a subsea pressure compensating pump unit according to a specific example embodiment of the disclosure.
Figure 2E:
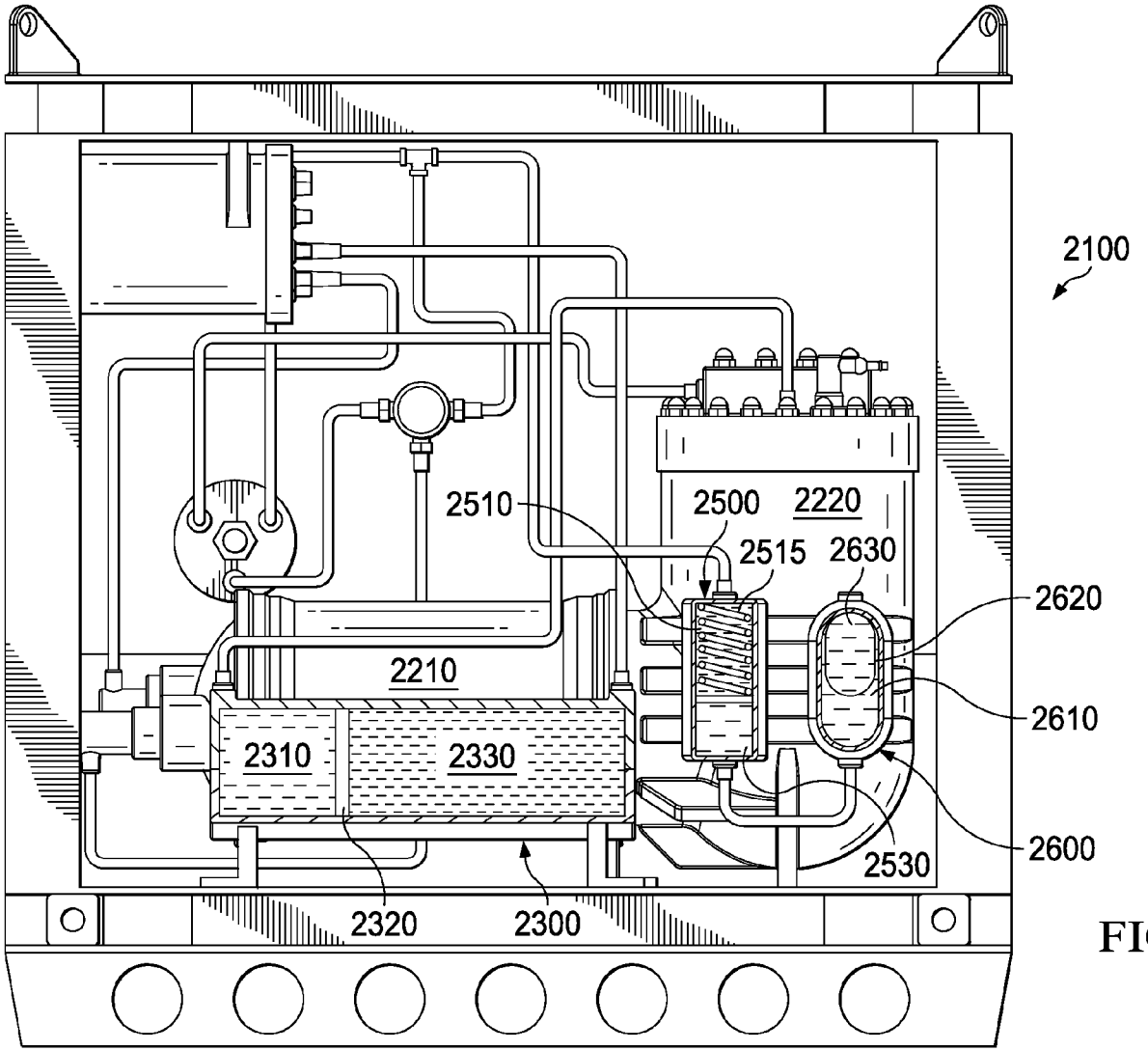
FIG. 2E illustrates a subsea pressure compensating pump unit according to a specific example embodiment of the disclosure.
Figure 2F:
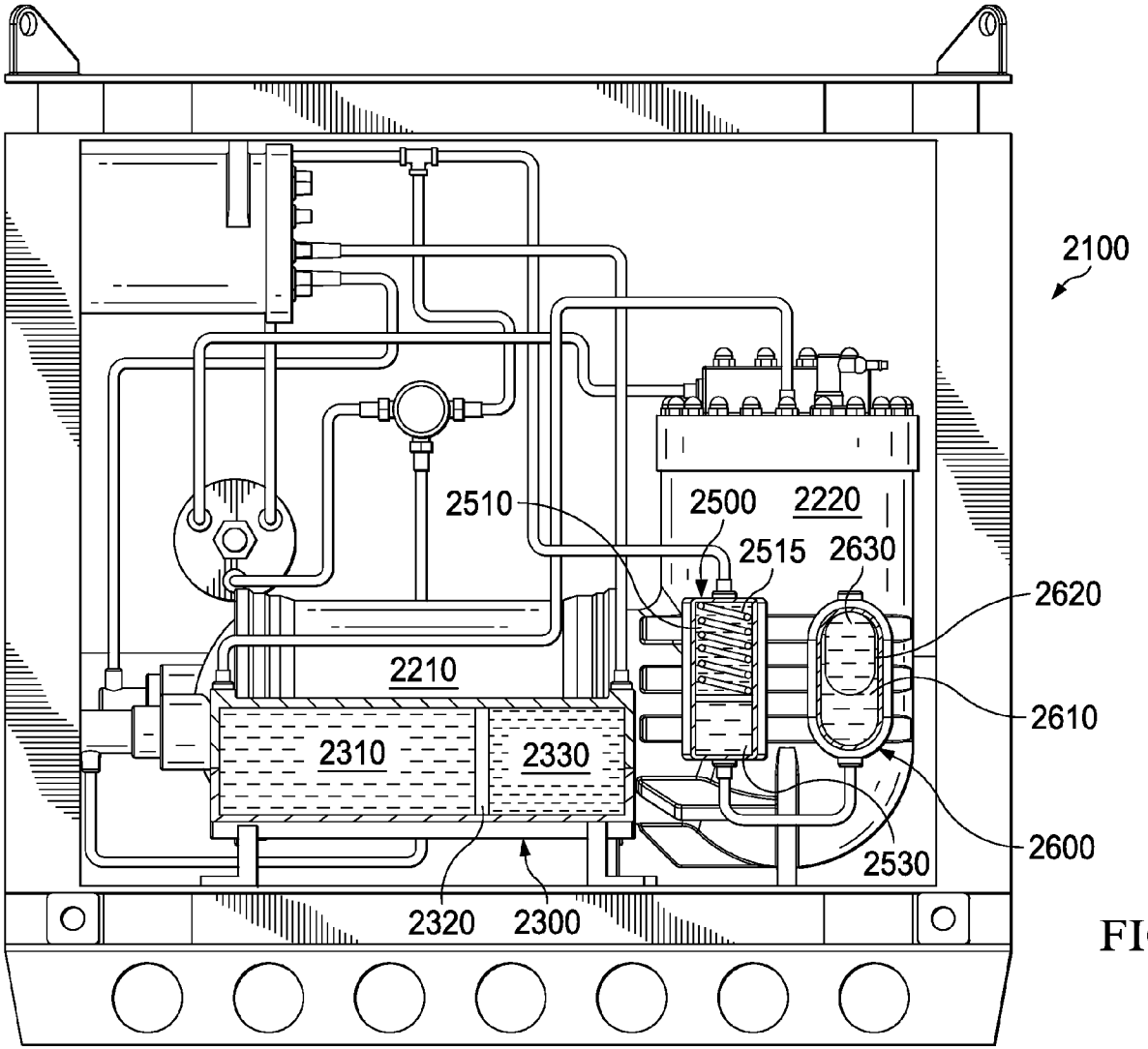
FIG. 2F illustrates a subsea pressure compensating pump unit according to a specific example embodiment of the disclosure.
Figure 2G:
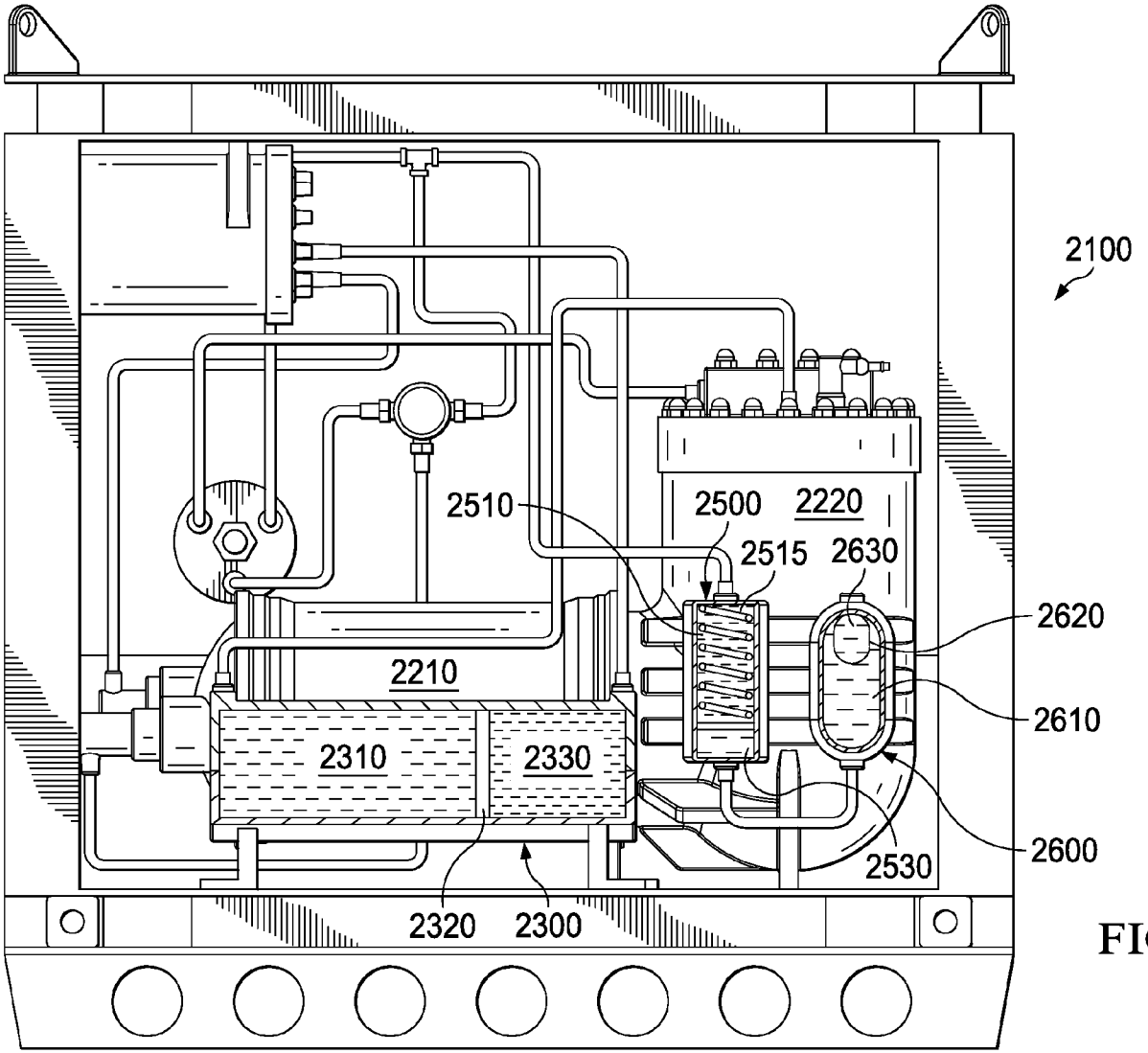
FIG. 2G illustrates a subsea pressure compensating pump unit according to a specific example embodiment of the disclosure.
Figure 2H:
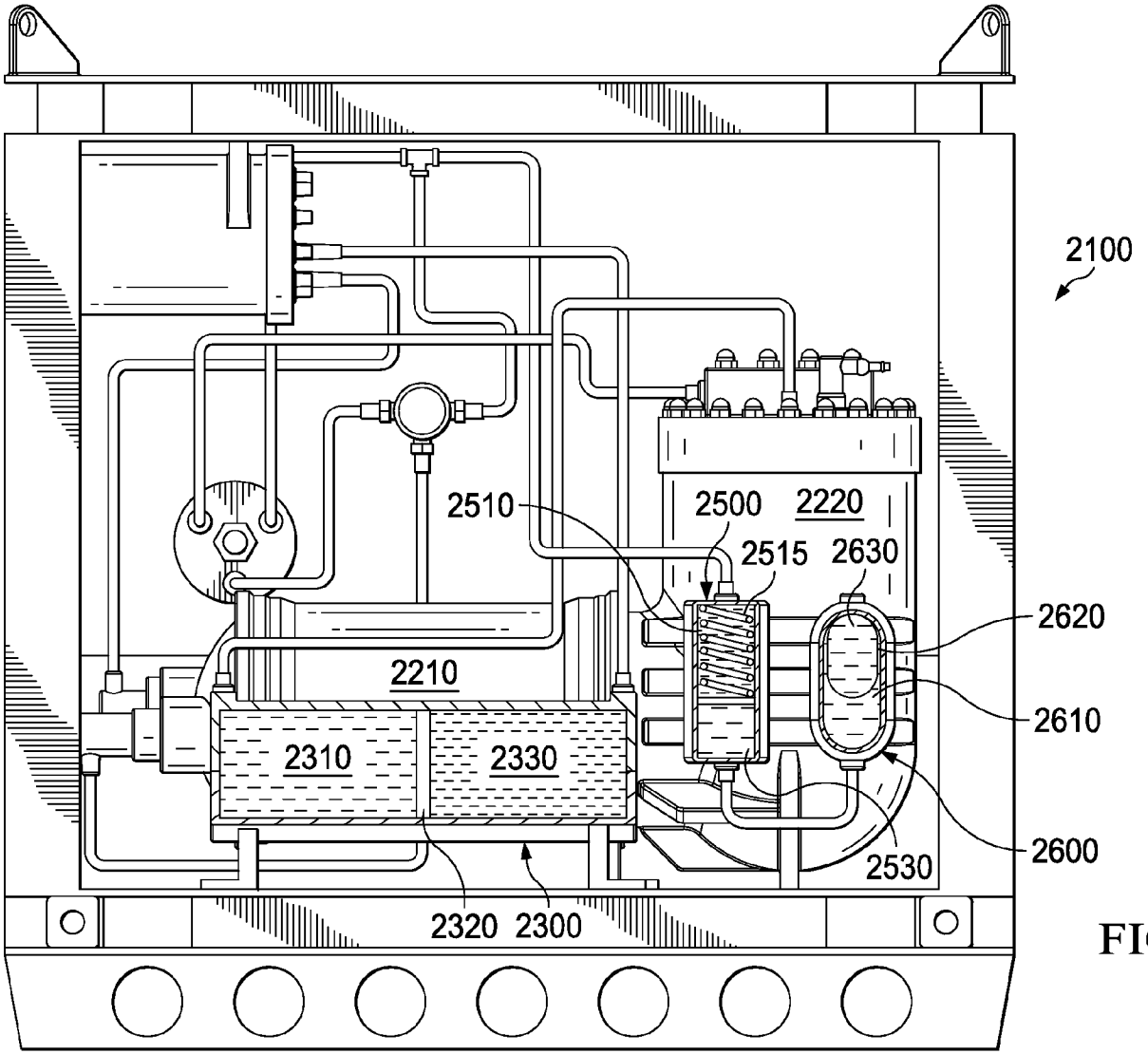
FIG. 2H illustrates a subsea pressure compensating pump unit according to a specific example embodiment of the disclosure.
Figure 3:
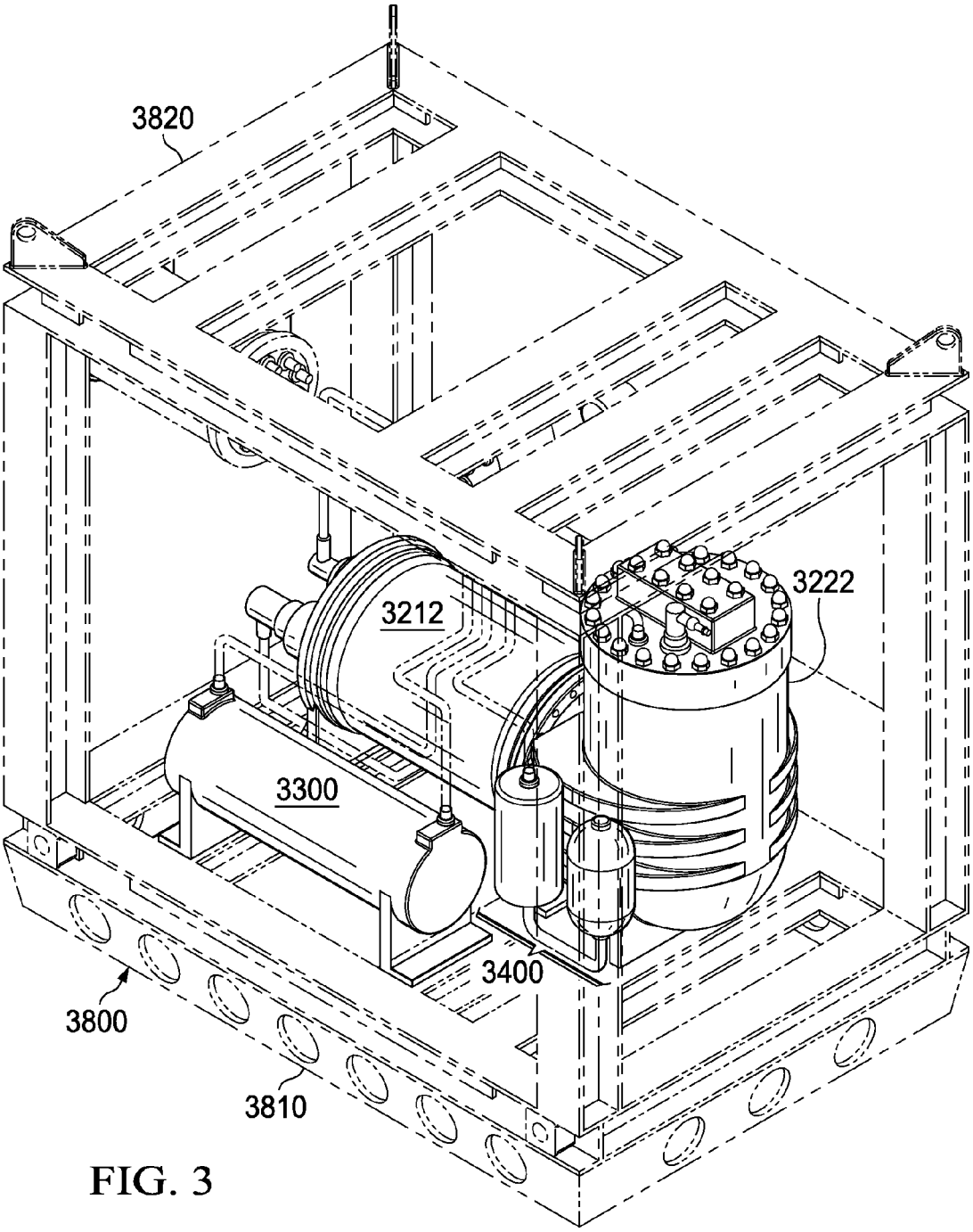
FIG. 3 illustrates a subsea pressure compensating pump unit according to a specific example embodiment of the disclosure.

| | FIG. 1 | FIG. 2 | FIG. 3 |
|---|---|---|---|
| Pump unit | 1100 | 2100 | |
| Suction Circuit Line | 1101 | | |
| Discharge Circuit Line | 1150 | | |
| Pump-Motor | 1200 | | |
| Motor | 1210 | 2210 | |
| Motor Housing | 1212 | | 3212 |
| Pump | 1220 | 2220 | |
| Pump Housing | 1222 | | 3222 |
| Suction Circuit Inlet | 1224 | | |
| Discharge Circuit Outlet | 1225 | | |
| Lubrication Fluid | 1296 | | |
| Fluid Line | 1298 | | |
| Housing Compensator | 1300 | 2300 | 3300 |
| Lubrication Fluid Chamber | 1310 | 2310 | |
| Separator | 1320 | 2320 | |
| Suction Fluid Chamber | 1330 | 2330 | |
| Suction Circuit Fluid | 1396 | | |
| Housing Compensator Fluid Line | 1398 | | |
| Suction Compensator | 1400 | | 3400 |
| Suction Circuit Fluid | 1496 | | |
| Spring Compensator Fluid Line | 1498 | | |
| Spring Compensator | 1500 | 2500 | |
| Suction Fluid Chamber | 1510 | 2510 | |
| Spring/Piston | 1515 | 2515 | |
| Separator | 1520 | 2520 | |
| Compensation Fluid Chamber | 1530 | 2530 | |
| Compensation Fluid | 1596 | | |
| Fluid Line | 1598 | | |
| Ambient Fluid Compensator | 1600 | 2600 | |
| Residual Volume | 1610 | 2610 | |
| Ambient Fluid Bladder | 1620 | 2620 | |
| Ambient Fluid Bladder Volume | 1630 | 2630 | |
| Ambient Fluid | 1696 | | |
| Ambient Fluid Line | 1698 | | |
| Skid | | | 3800 |
| Base | | | 3810 |
| Frame | | | 3820 |

DETAILED DESCRIPTION

The present disclosure relates, in some embodiments, to fluid pump apparatus, systems, and methods using and/or including dynamic pressure compensation. For example, a pump apparatus and/or system may include a first pressure compensator and/or a second pressure compensator. A first pressure compensator may be configured to deliver to or release from a pump housing pump housing fluid(s) as pressure increases and/or decreases. A second pressure compensator may be configured to dampen or eliminate pressure changes that may otherwise occur in a fluid line when fluid flow is changed (e.g., a pump starting up or shutting down, a valve being opened or close, flow throttled with a regulator). In some embodiments, a dynamic pressure compensation unit may comprise a first fluid compensator and a second fluid compensator operably linked (e.g., fluidically connected) to the first fluid compensator. A pump unit may comprise a fluid pump, a first compensator, and/or a second compensator, the first and second compensators in fluid communication with each other and each in fluid communication with the fluid pump (e.g., in series or in parallel).

In some embodiments, the present disclosure may provide for a mechanism to equalize pressure differentials across a pump deployed and/or installed in a subsea environment. Embodiments of the present disclosure may protect a subsea pump's interior against differential pressures caused by a hydrostatic pressure of sea water, transient pressure changes during startup and shutdown, changes of temperature, and other variables. Equalization of pressure differentials may be advantageous for a subsea pump during, but not limited to, deployment, startup, operation, shutdown, and retrieval of a subsea pump. Use of a subsea pump according to the present embodiments may enable a subsea pump deployed and/or installed in a subsea environment to energize fluids for delivery to particular locations. For example, a subsea pump of the present disclosure may move fluids from a subsea storage system towards various locations such as a subsea oil and/or gas production system. In such manner, embodiments of the present disclosure may allow a pump to support, treat, and control subsea fluid systems, such as subsea oil and/or gas production systems, in subsea environments.

Pressure compensators may allow pumps to control or withstand a pressure differential between an internal housing of the pump and an ambient environment. Thus, a pump configured with a pressure compensator may be deployed in subsea environments and may operate in such environments to energize fluids subsea, and to support, treat, and control subsea fluid systems, such as subsea oil and/or gas production systems. A pressure compensator may maintain a pressure differential during deployment, retrieval, startup, shutdown, and during normal operation. In such manner, dynamic pressure compensation may be provided to a subsea pump unit. In some embodiments, the present disclosure may provide for pressure compensators that may comprise a suction compensator, a housing compensator, and a pump.

Suction Compensator

A suction compensator may comprise an ambient fluid compensator and a spring compensator. An ambient fluid compensator may comprise an ambient fluid bladder disposed within a volume of the ambient fluid compensator. In such manner, an ambient fluid bladder may partition or otherwise divide an inner volume of an ambient fluid compensator into a bladder volume and a residual volume. An ambient fluid bladder may be in fluid communication with an ambient fluid, such as seawater. Fluid communication may be established by a fluid line connected to an ambient fluid bladder. A fluid line may serve as a reference point to an ambient environment, thus allowing an ambient fluid bladder to intake or expel an ambient fluid, such as seawater. As ambient fluid may be received into or evacuated from an ambient fluid bladder, a bladder volume may expand or contract. As a result, a residual volume of an ambient fluid compensator may contract as a bladder volume expands, or expand as a bladder volume contracts. The residual volume may be filled with a compensation fluid. A compensation fluid may, for example, comprise and/or may be mineral oil. Other suitable compensation fluids may be used without departing from the scope of the present disclosure.

A spring compensator may be a component of a suction compensator. A spring compensator may comprise an internal volume divided by a separator. A separator may partition a volume of a spring compensator into a suction fluid chamber and a compensation fluid chamber. In some embodiments, a separator may be a piston. A spring may be disposed within a suction fluid chamber such that an elastic force may be applied against a separator in a spring compensator. When fluid volumes within a suction fluid chamber and/or a compensation fluid chamber change, a position of a separator may change as well. A spring within a suction fluid chamber may elastically resist or facilitate a change in the position of a separator. As a result, fluid volume changes may also be resisted or facilitated. A compensation fluid chamber of a spring compensator may be filled with a compensation fluid. A compensation fluid in a compensation fluid chamber may be the same as a fluid within a residual volume of an ambient fluid compensator. A compensation fluid may, for example, be mineral oil. A suction fluid chamber of a spring compensator may be filled with a fluid from a suction circuit. A fluid from a suction circuit may be a fluid desired for pumping or transporting. Depending on a particular application for the present disclosure, a suction circuit fluid provided to a spring compensator may vary. In some embodiments, a suction circuit fluid may comprise and/or may be selected from hydrate inhibitors, scale inhibitors, drag reduction agents, asphaltene inhibitors, seawater, hydraulic fluid, and aromatic solvents. Other suitable suction circuit fluids may be used without departing from the scope of the present disclosure.

Housing Compensator

In some embodiments, a pressure compensator may comprise a housing compensator. A housing compensator may comprise an internal volume divided by a separator. A separator may partition an internal volume of a housing compensator into a suction fluid chamber and a lubrication fluid chamber. In some embodiments, a piston may serve as a separator. A suction fluid chamber of a housing compensator may be in fluid communication with a suction fluid chamber of a spring compensator. Fluid communication may be established by a fluid line or a plurality of fluid lines from a suction circuit. Thus, a volume of a suction fluid chamber of a housing compensator may vary as a result of pressure, temperature, and/or volume changes in a suction fluid chamber of a spring compensator. As a volume of a suction fluid chamber of a housing compensator varies, a separator disposed within a housing compensator may change in position. A suction fluid chamber of a housing compensator and a suction fluid chamber of a spring compensator may be filled with in the same fluid. As previously described, a suction circuit fluid may comprise and/or may be selected from hydrate inhibitors, scale inhibitors, drag reduction agents, asphaltene inhibitors, seawater, hydraulic fluid, and aromatic solvents. A lubrication fluid chamber of a housing compensator may be filled with a lubrication fluid. A volume of a lubrication fluid chamber may vary as a position of separator disposed within a housing compensator moves. In some embodiments, a lubrication fluid may comprise and/or may be selected from hydrate inhibitors, scale inhibitors, drag reduction agents, asphaltene inhibitors, seawater, hydraulic fluid, and aromatic solvents. Other lubrication fluids may be used without departing from the scope of the present disclosure.

Pump and Motor

In some embodiments, a pressure compensator may comprise a pump. A pump may be connectable with a suction circuit and a discharge circuit. A suction circuit may be filled with a fluid desired for pumping or transporting from or to a subsea fluid system. A pump may further comprise a housing defining a lubrication fluid compartment. A housing may be suitable for enclosing mechanical or operational components of a pump. A lubrication fluid compartment may surround working or operating components of a pump in such a way so that fluids provided or disposed therein may substantially or completely envelope working or operating components of a pump.

A lubrication fluid compartment may be in fluid communication with a lubrication fluid chamber of a housing compensator. Thus, a pressure and/or volume of a lubrication fluid compartment of a pump may vary and/or adapt as a pressure and/or volume of a lubrication fluid chamber of a housing compensator changes. As a result, adaptive pressure compensation may be provided to a pump that may be operating at high pressures in a subsea environment. A lubrication fluid in the housing may be pressurized relative to the suction fluid, however these fluids may not directly interact and may be physically separated.

According to the present disclosure, a pressure compensator may also comprise a motor used in conjunction with or as part of a pump. A motor may comprise a lubrication fluid compartment. A lubrication fluid compartment of a motor may also be filled with a lubrication fluid. As a result, a motor may be substantially or completely enveloped be a lubrication fluid during operation of a pump and/or a motor. In some embodiments, a lubrication fluid compartment of a motor may be in fluid communication with or may be adjoined to a lubrication fluid compartment of a pump housing. In some embodiments, a lubrication fluid compartment of a motor may be in fluid communication with or may be adjoined to a lubrication fluid chamber of a housing compensator. Arrangements provided herein may allow a lubrication fluid surrounding a motor to be responsive to changes in pressure and/or volume of a lubrication fluid chamber of a housing compensator changes. As a result, adaptive pressure compensation may be provided to a motor that may be operating at high pressures in a subsea environment.

According to some embodiments, a pump and a motor optionally may or may not be contiguous with each other. For example, a pump and a motor may be separate units fluidly and/or mechanically connected and/or in communication with one another. In some embodiments, a pump and a motor may be contiguous with each other. For example, a single housing may surround both elements. Such variations in the number of components, arrangement, and/or assembly of the pump and motor may be made without departing from the present disclosure.

Deployment

Before deploying a pump unit subsea, volumes of fluids in various chambers, compartments, and components may be adjusted to nominal values. Initial volumes may be a function of pressures and temperatures in an ambient environment during filling and operations. A contributor to changes in initial volumes may be a targeted subsea installation depth.

During deployment, a pump unit may be lowered or moved vertically through a water column. As a pump unit is lowered, ambient fluids, such as seawater, may be passed in and out of an ambient fluid bladder of a suction compensator. Passage of an ambient fluid in and out of a bladder may help account for changes of hydrostatic pressure due to depth. A pressure in an ambient fluid bladder of a suction compensator may be used to reference a pressure of a suction circuit and/or a pump housing.

A spring and a separator in a spring compensator may react to changes in pressure of an ambient fluid bladder in order to maintain a differential pressure between a pump's internal features and a pump housing. Similarly, a separator in a housing compensator may also react to changes in pressure of an ambient fluid bladder in order to maintain a differential pressure between a pump's internal features and a pump housing.

Initial Startup

A pump unit may undergo an initial startup phase. During initial startup, a pump's suction circuit may draw fluid from a suction circuit fluid chamber of a spring compensator of a suction compensator. Drawing fluid from a suction circuit fluid chamber may help to minimize the effects of accelerating a suction fluid and a consequential differential pressure between a suction circuit and an ambient environment. A suction compensator may reference an ambient fluid pressure through an ambient fluid bladder. During initial startup, an ambient fluid bladder may egress ambient fluids, such as seawater. Referencing an ambient fluid may help to account for changes in volume due to maintaining differential pressures associated with fluid acceleration.

As flow in a suction circuit stabilizes, a suction compensator's spring may be adjusted back to a nominal position. In some embodiments, a suction compensator may comprise a piston in a suction circuit fluid chamber. A piston may be adjusted back to a nominal position as ambient fluid flow stabilizes. Adjusting a piston back to nominal position may be achieved through internal springs. Internal springs may be sized such that a suction compensator's piston may not be affected by differential pressures generated by normal pump operation. Such sizing of internal springs may increase operational stability of a pump unit while operating in subsea environments.

Initial Shutdown

During initial pump shutdown, a suction compensator may also serve to minimize the effects of pressure differentials across a pump unit. A suction compensator may minimize the effects of decelerating a suction fluid (i.e. water hammer effect) by allowing ambient fluid, such as seawater, to ingress to an ambient fluid bladder. Ambient fluid ingressing to an ambient fluid bladder may act on springs within a suction circuit fluid chamber. A spring may compress during shutdown to absorb an impact from a rapidly decelerating fluid to reduce and/or eliminate extreme pressure changes to a suction chamber.

Static Operations

During static pump operations (i.e. not initial startup or shutdown), a differential pressure between a pump's suction circuit and a pump housing may be maintained due to small rapid differential pressure changes due to a pump's normal operation. Small rapid pressure differential changes may be maintained by the housing internal compensator. A spring inside a suction compensator may be sized to not allow piston and/or spring movement due to this pressure differential.

Springs within a suction compensator may be sufficiently sized to overcome high-frequency pressure changes resulting from cyclic suction pressures in a pump. Springs may help ensure that a stored fluid volume may be available to act as a "capacitor" during pump startup and shutdown, however it may be otherwise unaffected by normal operations.

During static pump operations (i.e. not initial startup or shutdown), a differential pressure between a pump housing and an ambient environment may be maintained as a result of gradual changes to volume due to temperature. A pump, motor, and/or other components within a housing may generate heat while operating. A lubrication fluid may absorb a generated heat and, as a result, may expand. As a lubrication fluid expands, a housing compensator's separator may adaptively adjust to maintain a differential pressure between a pump housing and an ambient environment.

Specific Example Embodiments

FIG. 1

Example Pump Structure

Specific example embodiments of a fluid pump unit are illustrated in FIGS. 1-3. FIG. 1 illustrates a schematic of a pump unit according to a specific example embodiment of the disclosure. As shown in FIG. 1, pump unit 1100 may comprise suction compensator 1400, housing compensator 1300, and pump-motor 1200.

Suction compensator 1400 may comprise ambient fluid compensator 1600 and spring compensator 1500. Ambient fluid compensator 1600 may comprise ambient fluid bladder 1620. Ambient fluid bladder 1620 may partition an internal volume of ambient fluid compensator 1600 into ambient fluid bladder volume 1630 and residual volume 1610. Ambient fluid bladder 1620 may reference ambient fluid 1696 through ambient fluid line 1698. Ambient fluid line 1698 may serve as an egress or ingress for ambient fluid 1696. Ambient fluid 1696 may be seawater. As ambient fluid 1696 enters or exits ambient fluid bladder 1620, an ambient fluid bladder volume 1630 may increase or decrease. An internal volume of ambient fluid compensator may be fixed. Thus, as ambient fluid bladder volume 1630 increases, residual volume 1610 may decrease. Conversely, as ambient fluid bladder volume 1630 decreases, residual volume 1610 may increase.

Spring compensator 1500 may comprise an internal volume partitioned by separator 1520 into suction fluid chamber 1510 and compensation fluid chamber 1530. Separator 1520 may be a piston. Spring 1515 may be disposed within suction fluid chamber 1510. Fluid line 1598 may establish fluid communication between residual volume 1610 and compensation fluid chamber 1530. Both residual volume 1610 and compensation fluid chamber 1530 may be filled with compensation fluid 1596. Changes in pressure and/or volume of one of residual volume 1610 and compensation fluid chamber 1530 may result in changes in pressure and/or volume of the other.

Housing compensator 1300 may comprise an internal volume partitioned by separator 1320 into suction fluid chamber 1330 and lubrication fluid chamber 1310. Separator 1320 may be a piston. Suction fluid chamber 1330 may be in fluid communication with suction fluid chamber 1510 of spring compensator 1500. Fluid communication may be established by fluid lines of suction circuit 1101.

As shown in FIG. 1, suction circuit 1101 may comprise a plurality of fluid lines. Suction circuit fluid 1396, 1496 may be disposed within suction circuit 1101, suction fluid chamber 1330 of housing compensator 1300, and suction fluid chamber 1510 of spring compensator 1500. Spring compensator fluid line 1498 may be in fluid communication with suction fluid chamber 1510 of spring compensator 1500. Housing compensator fluid line 1398 may be in fluid communication with suction fluid chamber 1330 of housing compensator 1300. Spring compensator fluid line 1498 and housing compensator fluid line 1398 may both be connected to and be in fluid communication with suction circuit 1101. In such manner, fluid lines of suction circuit 1101 may establish fluid communication between suction fluid chamber 1510 of spring compensator 1500 and suction fluid chamber 1330 of housing compensator 1300. Changes in pressure and/or volume of one of suction fluid chamber 1330 of housing compensator 1300 and suction fluid chamber 1510 of spring compensator 1500 may result in changes in pressure and/or volume of the other.

In some embodiments, pump-motor 1200 may comprise an adjoined pump housing 1222 and motor housing 1212. Other embodiments may comprise separate housings. Pump housing 1222 and motor housing 1212 may be configured to house motor 1210 and pump 1220. As shown in FIG. 1, a volume of pump housing 1222 and motor housing 1212 may provide additional spacing between the walls of the housing and pump 1220 and motor 1210. A volume or spacing may be configured to receive a fluid therein. For example, lubrication-motor housing fluid 1296 may be disposed within pump housing 1222 and motor housing 1212 such that pump 1220 and motor 1210 may be substantially or completely enveloped by lubrication motor housing fluid 1296.

Pump-motor 1200 may be in fluid communication with housing compensator 1300. More specifically, in some embodiments, lubrication fluid chamber 1310 may be in fluid communication with pumping housing 1222 and/or motor housing 1212. Fluid line 1298 may connect lubrication fluid chamber 1310 with pumping housing 1222 and/or motor housing 1212. Changes in pressure and/or volume of one of lubrication fluid chamber 1310, pumping housing 1222, and/or motor housing 1212 may result in changes in pressure and/or volume of the others. Pump-motor 1200 may also be in fluid communication with suction circuit inlet 1224 of suction circuit 1101. Pump-motor 1200 may also be in fluid communication with discharge circuit outlet 1101 of discharge circuit 1150.

FIG. 2A

Prior to Deployment

FIGS. 2A-H illustrate example subsea a specific example embodiment of a pressure compensating pump unit at various stages of its operation. Visible features include the relative volumes of the chambers within the compensators and the positions or the respective separators. Positions and arrangements of various components may be varied without departing from the present disclosure.

FIG. 2A illustrates a pump unit as it may be configured prior to deployment. Prior to deployment, ambient fluid bladder 2600 may be substantially or completely empty. Thus, ambient fluid bladder volume 2630 of ambient fluid bladder 2600 may effectively be zero. In this state, an internal volume of ambient fluid compensator 2600 may substantially or nearly entirely comprise residual volume 2610. Further, piston 2515 may not be significantly or at all compressed. Piston 2515 may be in an expanded state, providing for a large volume of suction fluid chamber 2510. In this state, a volume of compensation fluid chamber 2530 in spring compensator 2500 may be very small.

Prior to deployment, separator 2320 of housing compensator 2300 may be close to the middle of housing compensator 2300. In some embodiments, prior to deployment, there may be an equal amount of suction circuit fluid in suction fluid chamber 2330 as there may be lubrication fluid in lubrication fluid chamber 2310.

FIG. 2B

Mid-Depth

FIG. 2B illustrates a pump unit as it may be configured or operated at mid-depth of deployment. For example, FIG. 2B may illustrate a pump unit at 2000*m* below surface. However, a particular depth described at mid-depth may vary depending on a target depth for a pump unit.

At mid-depth, ambient fluid bladder 2620 may have begun to intake an ambient fluid, such as seawater. As seawater enters ambient fluid bladder 2620, ambient fluid bladder volume 2630 may increase as ambient fluid bladder 2620 expands. Expansion of ambient fluid bladder 2620 may create pressure against a compensation fluid within residual volume 2610. Compensation fluid in residual volume 2610 may be in fluid communication with compensation fluid in compensation fluid chamber 2530 of spring compensator 2500. Compensation fluid may press against or provide pressure against piston 2515. Piston 2515 may move to balance suction circuit pressure to external ambient fluid pressure.

At mid-depth, separator 2320 of housing compensator 2300 may begin to move to counteract or balance suction circuit pressure to housing pressure. As shown, separator 2320 may move such lubrication fluid chamber 2310 has a smaller volume than suction fluid chamber 2330.

FIG. 2C

De-Energized Subsea

FIG. 2C illustrates a pump unit as it may be lowered further into a subsea environment. For example, FIG. 2B may illustrate a pump unit at 3000*m* below surface. As shown, ambient fluid bladder 2620 may have taken in more ambient fluid from an ambient environment. Accordingly, ambient fluid bladder 2620 may expand further and decrease residual volume 2610. Pressure from ambient fluid and ambient fluid bladder 2620 may cause piston 2515 to contract further, allowing more space for compensation fluid to fill compensation fluid chamber 2530. Pressure from ambient fluid and ambient fluid bladder 2620 may also cause separator 2320 of housing compensator 2300 to move even further against lubrication fluid, allowing more room for suction circuit fluid in suction fluid chamber 2330 and more pressure on lubrication fluid in lubrication fluid chamber 2310.

FIG. 2D

Initial Start Up

FIG. 2D illustrates a pump unit as it may be during initial start up. Initial start up may indicate that a pump unit has reached its targeted depth and may have been coupled to or otherwise engaged to a targeted subsea fluid system.

At initial start up, a suction circuit fluid or a pump media may be drawn out of suction fluid chamber 2510 of spring compensator 2500. Fluid may be drawn out to compensate for fluid acceleration. As fluid is drawn out, piston 2515 may collapse or compress into a more compact position. To account for volume changes in suction fluid chamber 2510 and compensation fluid chamber 2530 of spring compensator 2500, ambient fluid bladder 2620 may take in more ambient fluid to expand or increase ambient fluid bladder volume 2630.

Position of separator 2320, and volumes of lubrication fluid chamber 2310 and suction fluid chamber 2330 may be substantially similar to that shown in FIG. 2C.

FIG. 2E

Operation

FIG. 2E illustrates a pump unit as it may be during operation. Operation may indicate that a pump is functioning and serving to pump fluid from one subsea fluid system to another location.

During operation, fluid acceleration may decrease and a fluid flow may reach steady state. During this stage, piston 2515 may return to a nominal position. In some embodiments, as piston 2515 returns to a nominal position, a volume of suction fluid chamber 2510 may increase. As a result, a volume of compensation fluid chamber 2530 may decrease. To counteract volume changes, ambient fluid bladder 2620 may expel its contents into an ambient environment.

During operation, a pressure of a lubrication fluid surrounding a motor and/or pump may be stabilized or held constant. Thus, position of separator 2320, and volumes of lubrication fluid chamber 2310 and suction fluid chamber 2330 in housing compensator 2300 may be substantially similar to that shown in FIG. 2C and FIG. 2D.

FIG. 2F

Long Operation

FIG. 2E illustrates a pump unit as it may be during extended operation (e.g., operation that occurs over several hours or more). Extended operation may also be characterized by extended use of the motor over a period of time which may result in an expansion of a lubrication fluid. Other steps described herein may be completed in less time. For example, certain steps may only have a duration of several seconds.

As subsea pumping operation continues, temperature of lubrication fluid surrounding pump 2220 and motor 2210 may being to rise. Separator 2320 may move to counteract an increase in volume of lubrication fluid that may occur as a result of rising temperatures. As a result of an expanding volume of lubrication fluid chamber 2310 and repositioning of separator 2320, a volume of suction fluid chamber 2330 may decrease.

Stiffness of spring 2515 may be customized or adjusted such that spring 2515 may be prohibited from moving during stead state operation. Accordingly, a volume of suction fluid chamber 2510 may not change as operation continues for extended periods of time in steady state. Thus, a volume of suction fluid chamber 2510, residual volume 2610, and ambient fluid bladder volume 2630 may be substantially similar to that shown in FIG. 2E.

FIG. 2G

Shutdown

FIG. 2G illustrates a pump unit as it may be during initial shutdown. During this stage, a pump may be shut down, and a fluid flowing in a suction circuit connected to a pump may be rapidly decelerating. In some embodiments, water hammer may be experienced. A force from water hammer effects may overcome stiffness of spring 2515 and thereby expand a volume of suction fluid chamber 2510. As suction fluid chamber 2510 expands, compensation fluid chamber 2530 may be compressed. A compensation fluid within compensation fluid chamber 2530 may thus exert pressure against ambient fluid bladder 2620. Ambient fluid bladder 2620 may then expel at least a portion its contents into an ambient environment. Expelling contents of ambient fluid bladder 2620 may help to account for volume changes in other chambers.

During initial shutdown, position of separator 2320, and volumes of lubrication fluid chamber 2310 and suction fluid chamber 2330 may remain substantially the same as during operation.

FIG. 2H

Prolonged Shutdown

FIG. 2G illustrates a pump unit as it may be after shutdown, when a pump unit may be ready for retrieval. After shutdown, for a period of time a fluid in a suction circuit may decelerate. After deceleration comes to an end, spring 2515 may return to an intermediate position. Ambient fluid bladder 2620 may take in an ambient fluid to account for volume changes in compensation fluid chamber 2530 and residual volume 2610. Similarly, after shutdown, separator 2320 in a housing compensator 2300 may return to an initial, default position. In some embodiments, waiting for separator 2320 and spring 2515 to return to a default position prior to retrieval may promote system stability and prolonged use of a pump unit for subsea deployment.

FIG. 3

Skid System

Another aspect of the present disclosure provides for pump units secured within appropriate deployment skids. In some embodiments, a pump unit may be secured or housed within skid 3800. Skid 3800 may comprise base 3810 and frame 3820. A pump unit may rest on top of base 3800. For example, as shown in FIG. 3, a motor housing 3212, a pump housing 3222, a housing compensator, and a suction compensator 3400 may be arranged on top of base 3800 within frame 3820 of skid 3800.

Skid 3800 may provide security and stability for a pump unit. Further, skid 3800 may provide greater ease in deploying or retrieving a pump unit to and from subsea environments.

As will be understood by those skilled in the art who have the benefit of the instant disclosure, other equivalent or alternative compositions, devices, methods, and systems for fluid pump units may be envisioned without departing from the description contained herein. Accordingly, the manner of carrying out the disclosure as shown and described is to be construed as illustrative only.

One of ordinary skill in the art may make various changes in the shape, size, number, and/or arrangement of parts without departing from the scope of the instant disclosure. For example, the position and number of pistons and/or springs may be varied. In some embodiments, compensation fluids may be interchangeable. Interchageability may allow different compensations fluids to be selected based on particular operating depths or predicted pressures to be encounter by a pump unit. In addition, the size of a device and/or system may be scaled up or down to suit the needs of a particular pump unit or subsea fluid system. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes in methods of preparing and using a composition, device, and/or system of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value +/−about 10%, depicted value +/−about 50%, depicted value +/−about 100%) and/or a range endpoint. With respect to the former, a value of 50 depicted in an example, table, and/or drawing may form the basis of a range of, for example, about 45 to about 55, about 25 to about 100, and/or about 0 to about 100.

All or a portion of a device and/or system for fluid pump units may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

The invention claimed is:

1. A method of operating a fluid pump apparatus, the method comprising:

providing the fluid pump apparatus, the apparatus comprising:

a suction compensator comprising:

an ambient fluid compensator defining a first internal volume, an ambient fluid bladder disposed within the first internal volume, the ambient fluid bladder in fluid communication with an ambient fluid, the ambient fluid bladder partitioning the first internal volume into a bladder volume and a residual volume;

a spring compensator comprising:

a second internal volume, a first separator partitioning the second internal volume into a first suction fluid chamber and a compensation fluid chamber, a spring disposed within the first suction fluid chamber, wherein compensation fluid chamber is in fluid communication with the residual volume of the suction compensator;

a housing compensator comprising:

a third internal volume, a second separator partitioning the third internal volume into a second suction fluid chamber and a lubrication fluid chamber, wherein the second suction fluid chamber is in fluid communication with the first suction fluid chamber of the suction compensator;

a pump comprising:

a housing defining a first lubrication fluid compartment, the first lubrication fluid compartment in fluid communication with the lubrication fluid chamber of the housing compensator, the first lubrication fluid compartment connectable with a suction circuit and a discharge circuit;

disposing a compensation fluid within the residual volume and the compensation fluid chamber;

disposing a suction circuit fluid within the first suction fluid chamber and the second suction fluid chamber;

disposing a lubrication fluid within the lubrication fluid chamber and the first lubrication fluid compartment; and submerging the apparatus in an ambient fluid environment.

2. The method of operating the fluid pump apparatus in claim 1, the method further comprising:

receiving the ambient fluid into the ambient fluid bladder, whereby receiving the ambient fluid into the ambient fluid bladder expands the bladder volume and reduces the residual volume;

exerting pressure against the first separator, whereby exerting pressure against the first separator decreases a volume of the first suction fluid chamber;

exerting pressure against the second separator, whereby exerting pressure against the second separator increases a volume of the second suction fluid chamber and reduces a volume of the first lubrication fluid compartment; and operating the pump.

3. The method of operating the fluid pump apparatus in claim 2, the method further comprising:

shutting down the pump;

receiving water hammer fluid into the first suction fluid chamber; whereby receiving the water hammer fluid expands the spring and increases the volume of the first suction fluid chamber;

exerting pressure against the ambient fluid bladder, whereby exerting pressure against the ambient fluid bladder expels at least a portion of the ambient fluid into the ambient fluid environment.

4. The method of operating the fluid pump apparatus in claim 3, the method further comprising:

retrieving the fluid pump apparatus from the ambient fluid environment.

5. The method of operating the fluid pump apparatus in claim 1, the apparatus further comprising a motor comprising a second lubrication fluid compartment in fluid communication with the first lubrication fluid compartment.

6. The method of operating the fluid pump apparatus in claim 1, the apparatus further comprising a motor comprising a second lubrication fluid compartment in fluid communication with the lubrication fluid chamber of the housing compensator.

7. The method of operating the fluid pump apparatus in claim 1, wherein fluid communication between the residual volume of the suction compensator and the compensation fluid chamber is established by a fluid line therebetween.

8. The method of operating the fluid pump apparatus in claim 1, wherein fluid communication between the lubrication fluid chamber and the first lubrication fluid compartment is established by a fluid line therebetween.

9. The method of operating the fluid pump apparatus in claim 1, wherein ambient fluid comprises seawater.

10. The method of operating the fluid pump apparatus in claim 1, wherein a compensation fluid is disposed within the residual volume of the suction compensator and the compensation fluid chamber.

11. The method of operating the fluid pump apparatus in claim 1, wherein the compensation fluid is mineral oil.

12. The method of operating the fluid pump apparatus in claim 1, wherein the lubrication fluid is selected from a group consisting of hydrate inhibitors, scale inhibitors, drag reduction agents, asphaltene inhibitors, seawater, hydraulic fluid, and aromatic solvents.

13. A fluid pump apparatus, the apparatus comprising:

a suction compensator comprising:

an ambient fluid compensator defining a first internal volume, an ambient fluid bladder disposed within the first internal volume, the ambient fluid bladder in fluid communication with ambient fluid, the ambient fluid bladder partitioning the first internal volume into a bladder volume and a residual volume;

a spring compensator comprising:

a second internal volume, a first separator partitioning the second internal volume into a first suction fluid chamber and a compensation fluid chamber, a spring disposed within the first suction fluid chamber, wherein the compensation fluid chamber is in fluid communication with the residual volume of the suction compensator;

a housing compensator comprising:

a third internal volume, a second separator partitioning the third internal volume into a second suction fluid chamber and a lubrication fluid chamber, wherein the second suction fluid chamber is in fluid communication with the first suction fluid chamber of the suction compensator;

a pump comprising:

a housing defining a first lubrication fluid compartment, the first lubrication fluid compartment in fluid communication with the lubrication fluid chamber of the housing compensator, the first lubrication fluid compartment connectable with a suction circuit and a discharge circuit.

14. The subsea pump apparatus of claim 13, the apparatus further comprising a motor comprising a second lubrication fluid compartment in fluid communication with the first lubrication fluid compartment.

15. The subsea pump apparatus of claim 13, the apparatus further comprising a motor comprising a second lubrication fluid compartment in fluid communication with the lubrication fluid chamber of the housing compensator.

16. The subsea pump apparatus of claim 13, wherein fluid communication between the residual volume of the suction compensator and the compensation fluid chamber is established by a fluid line therebetween.

17. The subsea pump apparatus of claim 13, wherein fluid communication between the lubrication fluid chamber and the first lubrication fluid compartment is established by a fluid line therebetween.

18. The subsea pump apparatus of claim 13, wherein the ambient fluid comprises seawater.

19. The subsea pump apparatus of claim 13, wherein a compensation fluid is disposed within the residual volume of the suction compensator and the compensation fluid chamber.

20. The subsea pump apparatus of claim 19, wherein the compensation fluid is mineral oil.

21. The subsea pump apparatus of claim 13, wherein a suction fluid is disposed within the first suction fluid chamber and the second suction fluid chamber.

22. The subsea pump apparatus of claim 13, wherein a lubrication fluid is disposed within the first lubrication fluid compartment and the lubrication fluid chamber.

23. The subsea pump apparatus of claim 22, wherein the lubrication fluid is selected from a group consisting of hydrate inhibitors, scale inhibitors, drag reduction agents, asphaltene inhibitors, seawater, hydraulic fluid, and aromatic solvents.

* * * * *